US010571234B1

(12) United States Patent
Morelli et al.

(10) Patent No.: US 10,571,234 B1
(45) Date of Patent: Feb. 25, 2020

(54) VENTING LIFTING PLUG FOR MUNITIONS

(71) Applicant: U.S. Government as Represented by the Secretary of the Army, Picatinny Arsenal, Dover, NJ (US)

(72) Inventors: William Morelli, Spring Lake, NJ (US); Stojan Kotefski, Bloomingdale, NJ (US); Nikola Kotevski, Bloomingdale, NJ (US); Ductri Nguyen, Parsippany, NJ (US); Dominick DeMella, Hamburg, NJ (US); Paul Manz, Andover, NJ (US); Philip Magnotti, Westfield, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/920,636

(22) Filed: Mar. 14, 2018

(51) Int. Cl.
*F42B 39/20* (2006.01)
*F42B 39/14* (2006.01)
*F42C 19/04* (2006.01)

(52) U.S. Cl.
CPC ..... *F42B 39/20* (2013.01); *F42B 39/14* (2013.01); *F42C 19/04* (2013.01)

(58) Field of Classification Search
CPC ..... F42B 39/14; F42B 39/20; F42C 19/04
USPC ..... 102/481; 137/72, 73, 74; 220/89.4
See application file for complete search history.

(56) References Cited

U.S. PATENT DOCUMENTS

| | | | | |
|---|---|---|---|---|
| 195,367 | A | 9/1877 | Hiller | |
| 3,173,364 | A * | 3/1965 | Nordzell | F42B 3/00 102/481 |
| 3,665,857 | A * | 5/1972 | Radnich | F42B 39/00 102/481 |
| 3,927,791 | A | 12/1975 | Hershberger | |
| 4,205,608 | A | 6/1980 | Nicolaides | |
| 5,035,181 | A * | 7/1991 | Jacks | F42B 39/20 102/293 |
| 6,752,085 | B2 * | 6/2004 | Roach | F42B 39/14 102/481 |
| 7,451,703 | B1 * | 11/2008 | Dabiri | F42B 39/20 102/200 |
| 8,596,290 | B2 * | 12/2013 | Kotefski | B65D 90/32 137/72 |
| 8,596,291 | B2 | 12/2013 | Kotefski | |
| 9,631,911 | B2 * | 4/2017 | Jung | F42B 39/20 |
| 10,066,917 | B1 * | 9/2018 | Youn | F42B 3/006 |
| 10,228,223 | B1 * | 3/2019 | Hardt | F42B 12/207 |
| 10,378,870 | B1 * | 8/2019 | Wu | F42C 19/02 |
| 2003/0217770 | A1 | 11/2003 | Schultz | |

* cited by examiner

*Primary Examiner* — James S Bergin
(74) *Attorney, Agent, or Firm* — John P. DiScala

(57) ABSTRACT

A venting lifting plug is provided for an unfuzed munition having a cavity with internal threads.

8 Claims, 6 Drawing Sheets

VENTING LIFTING PLUG FOR MUNITIONS

STATEMENT OF GOVERNMENT INTEREST

The inventions described herein may be manufactured, used and licensed by and for the United States Government.

FIELD OF THE INVENTION

The present invention relates in general to a venting means for munitions such as artillery shells, bombs, rockets, torpedoes, and any other munition that is transported and/or stored without a fusing mechanism.

BACKGROUND OF THE INVENTION

The United States Department of Defense has mandated that munitions be designed to withstand unplanned stimuli and improve survivability throughout its life cycle. Specifically cook-off or temperatures higher than operating temperatures are one of these unplanned stimuli and the proposed innovation for the lifting plug addresses this issue. The U.S. Army and U.S. Marine Corps field artillery units are equipped with the M109A6 Self Propelled Howitzer, M198, and/or M777A2 Joint Lightweight Towed Howitzers that use the M795 High Explosive (HE) projectile. This M795 projectile is a typical round that is packaged and transported with a lifting plug and before use, a fuze replaces the lifting plug to make the round ready for its mission. Additionally, there are other projectiles that use the lifting plug as a transport and drop indication means.

These munitions have a threaded fuze cavity (not shown) into which can be inserted a lifting plug shown generally at 37 in FIGS. 1A and 1B. Lifting plug 37 comprises lifting ring 39 connected to neck 41 and threaded round portion 43.

The lifting plug is used as a shipping means to not only lift the munitions but to also protect the munitions from the environment until the fuze is attached. In protecting the munitions until the fuze is attached, the lifting plug seals the munition, and, under high temperatures, the sealing of the munition may cause a high-order detonation under high temperatures.

In general, munitions have operating temperatures between −60° F. to 160° F. In case of a fire, the temperature of the munition raises beyond a safe operating temperature of, for example, 160° F., and the energetics inside the munition phase change from solid to liquid causing an internal "hoop pressure" that causes the munition to explode in a high order reaction. This reaction is undesired and if the internal hoop pressure could be relieved, the energetics would not undergo a high order reaction or detonation but instead a combustion or burning, which is deemed safer for firefighting and overall physical damage/destruction.

The severity of a high order energetic reaction is the desired effect or function for explosives confined in thick steel walled projectiles. This combination creates the lethality and fragmentation requirements for munitions under standard operational scenarios but in non-operational scenarios, such as when munitions are exposed to elevated temperatures, the energetics can self-detonate and create undesired explosions which can cause loss of life, material damage and destruction of facilities and transport vehicles. In these elevated temperature scenario's, venting is critical to limit the warhead reaction reducing the high order reaction into a combustion or burning reaction. Accordingly, projectile modifications are desired to incorporate venting means for the energetics under these non-operating temperature exposures.

Several different lifting plug designs have been developed and tested over the years. Venting and drop indicator features have always been a consideration but have not been successful in achieving both characteristics. Prior art lifting plugs shown in FIGS. 1A and 1B are designed to be able to;

a) Support the weight of the round or pallet during transportation.
b) Deform or break if the round has been dropped with significant energy imparted to potentially cause structural damage to the ogive; thus giving a visual drop indicator.
c) Seal the round fuze cavity during the packaging transportation of the round until the fuze is assembled.

The drop indicator capability is illustrated in FIGS. 2A and 2B. The drop indicator capability is an essential feature of a lifting plug, used to identify rounds that have the potential of detonating within the cannon tube due to cracks in the energetic material.

The neck 41 can be formed of a frangible or weakened material which is designed to either rupture the neck 41 as shown in FIG. 2A or deform the neck 41 as shown in FIG. 2B when the munition is subjected to rough handling which might damage the munition itself and create an unsafe and/or unstable munition.

Some prior art lifting plug designs incorporate wax material that would soften at temperatures below the explosive reaction temperature to reduce confinement and prevent transition from deflagration to detonation, such as shown in FIG. 3. However, incorporation of the wax material resulted in degradation in the structural integrity of the lifting plug and its ability to accurately indicate excessive force impact to the ogive. This premature lifting plug failure results in a lower projectile availability to the users if projectiles were to experience rough handling in transportation. Wax material venting designs frequently have small vent holes, limiting the ability of the plug to vent energetic material.

In one approach, lifting plug 37 was modified to include a venting method using a wax material (FIG. 3). This lifting plug with a wax material was found to be ineffective since it interfered with the visual indicator provided by weakened neck 41 as illustrated in FIGS. 1A and 1B.

Similarly, designs utilizing threaded rings, such as the lifting plug disclosed in U.S. Pat. No. 8,596,291 limit the size of the vent opening, limiting the ability of the plug to vent energetic material.

Therefore, there remains a need for a lifting plug, capable of identifying rounds that have the potential of detonating within the weapon or cannon tube due to cracks in the energetic material, and that can vent the energetic material during cook-off or temperatures higher than normal operating temperatures.

SUMMARY OF THE INVENTION

After considerable investigation and research, applicants developed a means to an insensitive projectile or munition which performs as a normal munition under normal operating temperatures, but under elevated temperatures degrades itself to a combustible rather than a high order reaction. The current munition goes high order under elevated temperatures due to the mechanical seal between the lifting plug and the munition body. Under normal operating temperatures, this is a desired feature, but under higher temperatures this temperature and internal pressure increase cause an undesired detonation of the munition. In order to maintain all of the current safety features (drop indicator), the use of a ring was developed so that all of the current (conventional or prior art) lifting plug properties were maintained and a venting feature could be added to the lifting plug.

The ring has an external thread and one or more curved or flat or substantially flat internal surface or surfaces that engage or engages with the external surface or surfaces on a lifting plug and internal threads on the munition. The munitions threads are adapted to receive a threaded fuze for operational use and a lifting plug for packaging and transport use. To prevent the release of cook-off gases and energetic material created from the expansion of munitions energetics as the temperature is increased, but before a predetermined critical temperature is reached, the joint between the lifting plug and the ring is soldered with a eutectic solder formed from one or more eutectic materials. The eutectic solder melts at a predetermined temperature and allows the lifting plug to be ejected from the munition. The removal of the lifting plug from the munition eliminates pressure buildup within the munition cavity and thus a high order reaction cannot occur. This method of venting the lifting plug retains all of the mechanical properties under normal operating temperatures, but degrades the munition under predetermined elevated temperatures.

In a first embodiment, there is provided an unfuzed munition having a fuze cavity with internal threads adapted to receive a threaded fuze, with a lifting plug comprising a lifting ring connected to a neck portion which in turn is connected to an engagement portion having an outer surface, the unfuzed munition further comprising a ring threaded externally and having an interior surface configured to engage with the outer surface of the engagement portion, with the external threads adapted to engage internal threads on the threaded fuze cavity, wherein a gap is created that allows solder to flow between the interior surface of the ring and the external surface of the engagement portion of the lifting plug, the solder comprising one or more eutectic materials having a melting point below a predetermined critical temperature and pressure of cook-off gases generated by the munition.

In a second embodiment there is provided in connection with the first embodiment, an unfuzed munition, wherein the lifting plug separates from the ring when cook-off gas temperatures have risen high enough to melt the eutectic solder between the interior surface or surfaces of the ring and the external surface of the engagement portion of the lifting plug and pressure build-up of cook-off gases is sufficiently high to cause separation of the lifting plug.

In a third embodiment there is provided in connection with the first embodiment, an unfuzed munition, wherein the ring is formed of carbon steel or stainless steel that would have mechanical properties superior to the base material of the lifting plug.

In a fourth embodiment there is provided in connection with the first embodiment, an unfuzed munition, wherein the one or more eutectic materials wet the surfaces of both the lifting plug and ring and creates an environmental and pressure seal.

In a fifth embodiment there is provided in connection with the first embodiment, an unfuzed munition, wherein the lifting plug is in tight engagement with a ring which in turn is in threaded engagement with a fuze cavity of a munition.

In a sixth embodiment there is provided in connection with the fifth embodiment, an unfuzed munition, wherein a joint between the lifting plug and the ring is soldered with one or more eutectic materials, which wets both surfaces of the joint.

In a seventh embodiment there is provided in connection with the sixth embodiment, an unfuzed munition, wherein the one or more eutectic materials is used to provide a pressure and mechanical seal between the lifting plug and the ring joint.

In an eighth embodiment there is provided in connection with the seventh embodiment, an unfuzed munition, wherein the one or more eutectic materials seals the joint and prevents release of cook-off gases and munitions content until these gases and content reach a predetermined temperature.

In a ninth embodiment there is provided in connection with the first embodiment, an unfuzed munition, wherein the interior surface of the ring and external surface on the lifting plug are coated with tin coating to facilitate wetting of the threaded joint by the one or more eutectic materials. Or any other coating material used to wet solders and eutectic solders.

In a tenth embodiment there is provided in connection with the first embodiment, an unfuzed munition, wherein there is a sufficient clearance between the interior surface of the threaded ring and the external surface of the engagement portion of the lifting plug to facilitate flow of the one or more eutectic materials into the joint, and the ring is formed from a material stronger than the material from which the neck of the lifting plug is formed, whereby to maintain a damage indicator feature of the lifting plug neck.

In an eleventh embodiment there is provided in connection with the first embodiment, an unfuzed munition, wherein the ring is formed from a material stronger than the material from which the neck of the lifting plug is formed, whereby to maintain a damage indicator feature of the lifting plug neck.

In a twelfth embodiment, there is provided a gas pressure discharge valve for an unfuzed munition having a fuze cavity with internal threads, said discharge valve comprising a ring threaded externally and having one or more smooth or substantially smooth interior surfaces, with the external threads adapted to engage internal threads on the threaded fuze cavity, and the one or more smooth or substantially smooth interior surfaces on the ring adapted to facilitate attachment of the ring to the lifting plug, wherein a gap (approximately about 0.002 to about 0.005 inch per side) is created that allows solder to flow between the ring and the external surface of the engagement portion of the lifting plug, the solder comprising one or more eutectic materials such as tin, bismuth, tin bismuth, lead or any other suitable alloy mixture to achieve the desired eutectic temperature having a melting point below a predetermined critical temperature and pressure of cook-off gases generated by the munition.

In a thirteenth embodiment there is provided in connection with the twelfth embodiment, a gas discharge valve, wherein the lifting plug separates from the ring when cook-off gas temperatures have risen high enough to melt the eutectic solder of the between the interior surface of the ring and external surface of the engagement portion of the lifting plug and pressure build-up of cook-off gases from the internal cavity contents is sufficiently high to cause separation of the lifting plug.

In a fourteenth embodiment there is provided in connection with the twelfth embodiment, a gas discharge valve, wherein the ring is formed of carbon steel, stainless steel, titanium, or other strong alloys thereof.

In a fifteenth embodiment there is provided in connection with the twelfth embodiment, a gas discharge valve, wherein the one or more eutectic materials wet the surfaces of both the lifting plug and ring and creates an environmental and pressure seal.

In a sixteenth embodiment there is provided in connection with the fifteenth embodiment, a gas discharge valve, wherein a joint between the lifting plug and the ring is soldered with one or more eutectic materials which wet both surfaces of the joint.

In a seventeenth embodiment there is provided in connection with the twelfth embodiment, a gas discharge valve, wherein the one or more eutectic material is selected from the group consisting of bismuth, lead, tin and any suitable combination of alloy mixtures to meet the temperature range needed.

In a eighteenth embodiment there is provided in connection with the seventeenth embodiment, a gas discharge valve, wherein the one or more eutectic material seals the joint and prevents release of cook-off gases until these gases reach a predetermined temperature, and the exterior surface of the engagement portion of the lifting plug, and the interior surface of the ring are coated with a wetting agent to facilitate wetting of the threaded joint by the one or more eutectic material.

In a nineteenth embodiment there is provided in connection with the twelfth embodiment, a gas discharge valve, wherein there is a sufficient clearance between the interior surface of the ring and the external surface of the engagement portion of the lifting plug to facilitate flow of eutectic material into the joint, and the ring is formed from a material stronger than the material from which the neck of the lifting plug is formed, whereby to maintain a damage indicator of the lifting plug neck.

In a twentieth embodiment, there is provided a venting lifting plug for an unfuzed munition having a fuze cavity with internal threads, said venting lifting plug comprising a ring threaded externally and having a smooth interior surface, with the external threads adapted to engage internal threads on the threaded fuze cavity, and the smooth interior surface on the ring adapted to facilitate attachment of the ring to the lifting plug, wherein a gap is created that allows solder to flow between the interior surface of the ring and the external surface of the engagement portion of the lifting plug, the solder comprising one or more eutectic materials having a melting point below a predetermined critical temperature and pressure of cook-off gases generated by the munition, and the ring is formed of carbon steel, and the one or more eutectic material wets surfaces of both the lifting plug and ring.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION

Figure 1A:
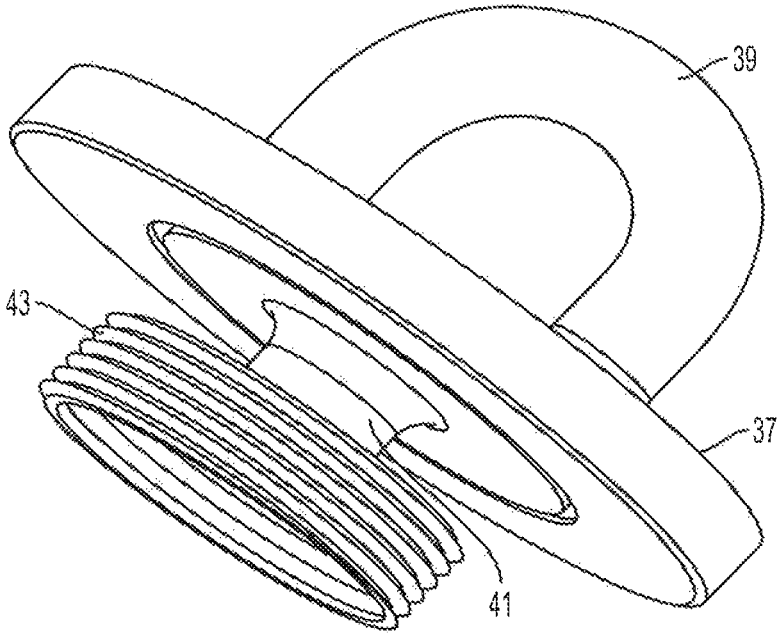
FIG. 1A PRIOR ART
FIG. 1A is a perspective view of a prior art lifting plug adapted to be in threaded engagement with a threaded fuze cavity on an unfuzed munition, illustrating in particular the threaded portion of the lifting plug.
Figure 1B:
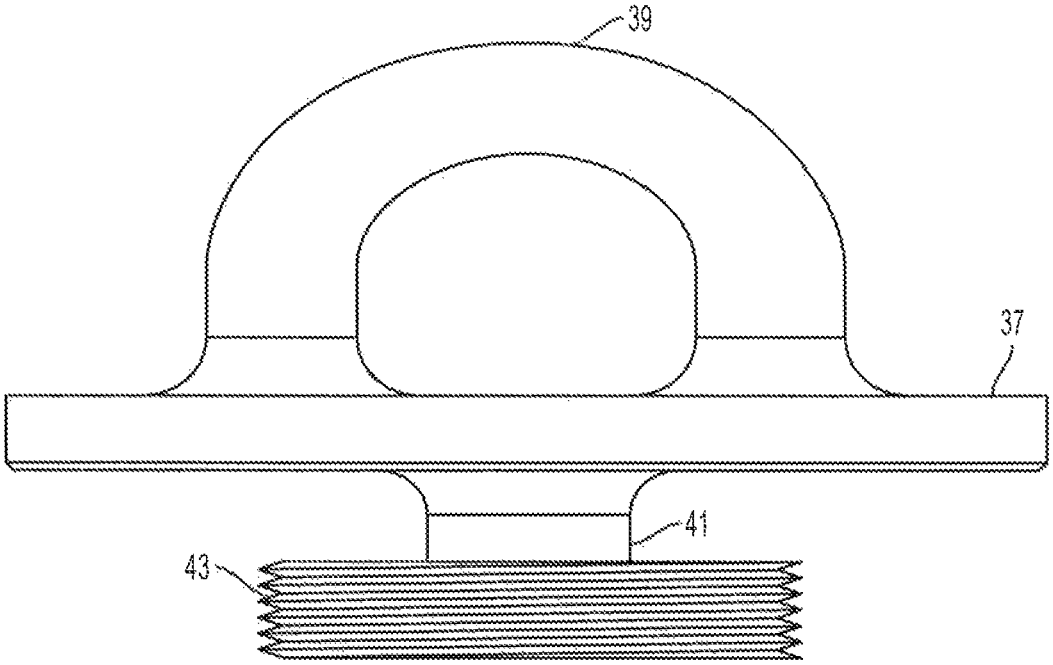
FIG. 1B PRIOR ART
FIG. 1B is a side view of a prior art lifting plug, also illustrating the neck portion connecting the threaded portion of the lifting plug.
Figure 2A:
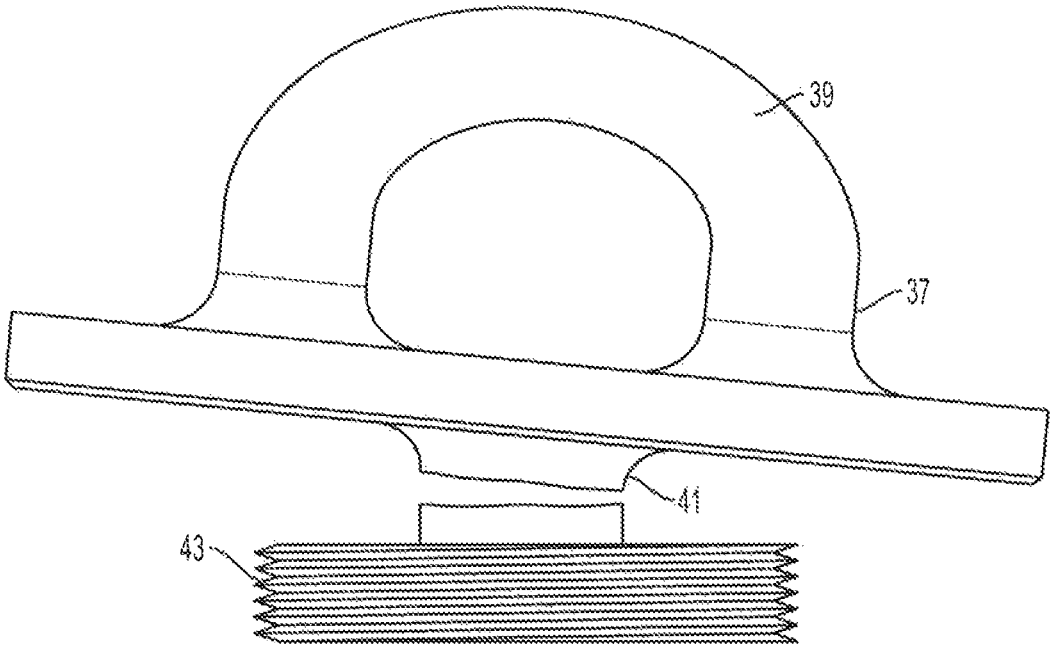
FIG. 2A PRIOR ART
FIG. 2A is a side view of a prior art lifting plug with a broken neck portion which is designed to break or deform when subjected to excessive loads, so as to provide a visual indication of possible damage to the munition.
Figure 2B:
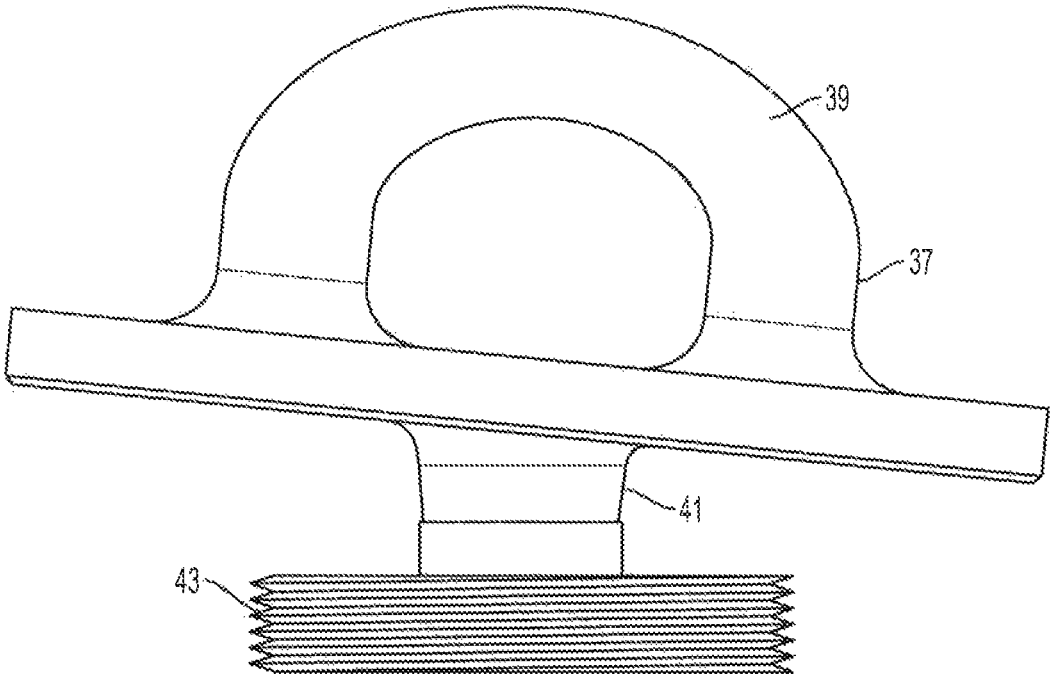
FIG. 2B PRIOR ART
FIG. 2B is a side view of a prior art lifting plug with a bent neck portion which has been designed to deform when subjected to excessive loads, thus providing a visual indication of possible damage to the munition.
Figure 3:
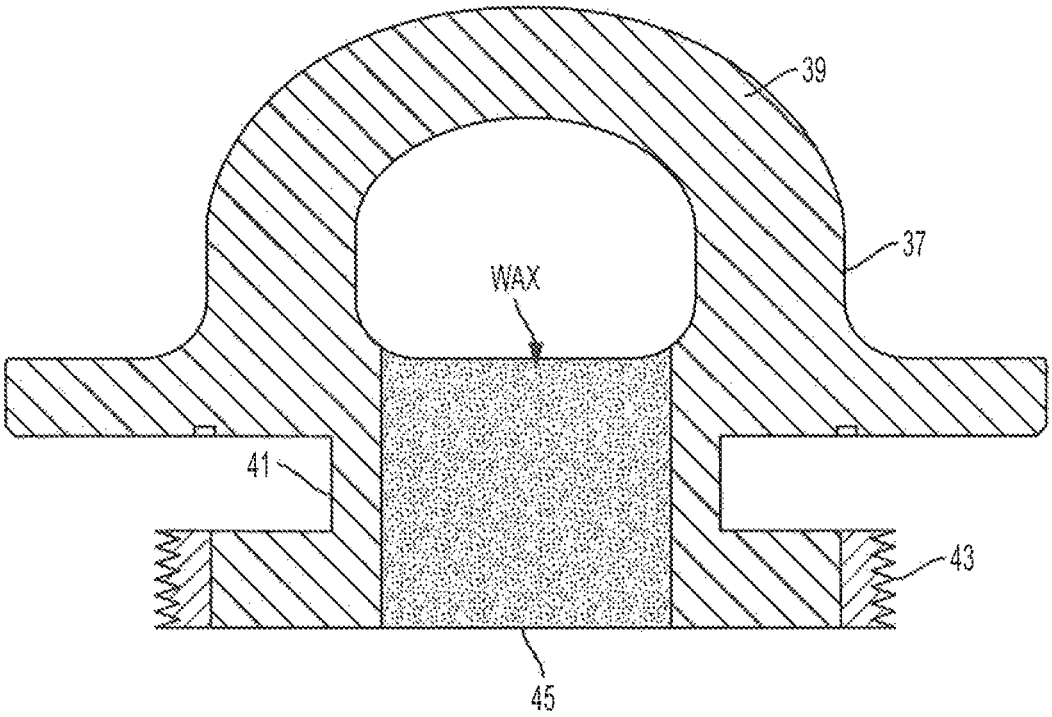
FIG. 3 PRIOR ART
FIG. 3 is a side view of a prior art lifting plug illustrating particularly a round cavity in the center of the plug which is filled with wax designed to melt and vent high temperature cook-off gases and energetics from the munition.

In the following description, reference is made to the accompanying drawings that form a part hereof, and in which is shown by way of illustration specific embodiments which may be practiced. These embodiments are described in detail to enable those skilled in the art to practice the invention, and it is to be understood that other embodiments may be utilized and that logical changes may be made without departing from the scope of the present invention. The following description of example embodiments is, therefore, not to be taken in a limited sense, and the scope of the present invention is defined by the appended claims.

The Abstract is provided to comply with 37 C.F.R. § 1.72(b) to allow the reader to quickly ascertain the nature and gist of the technical disclosure. The Abstract is submitted with the understanding that it will not be used to interpret or limit the scope or meaning of the claims.

As used herein, the term "substantially" refers to the complete or nearly complete extent or degree of an action, characteristic, property, state, structure, item, or result. For example, an object that is "substantially" flat would mean that the object is either completely flat or nearly completely flat. The exact allowable degree of deviation from absolute completeness may in some cases depend on the specific context. However, generally speaking the nearness of completion will be so as to have the same overall result as if absolute and total completion were obtained.

In certain embodiments, the present invention provides a venting lifting plug for munitions such as artillery shells, bombs, rockets, torpedoes, and any other munition which is transported and/or stored without a fusing mechanism. The venting lifting plug contains a lifting plug with a ring that is eutectically bonded to the lifting plug. In order to maintain the thread engagement capabilities of the lifting plug, the external threads of the ring match the prior art lifting plugs thread design, and the thread of the fuze cavity.

In order to attach the ring onto the lifting plug, the lifting plug needs to have its base made smaller to attach the ring, whilst keeping the final external diameter of the lifting plug the same as prior art lifting plugs. Stated another way, when assembled, the lifting plug and ring will have the same external profile as a conventional, or prior art lifting plug. Additionally, the joint of the lifting plug and ring will be sealed with one or more eutectic materials. The eutectic seal is to allow the lifting plug portion to remove itself off the ring and vent the cook-off gases from munitions when the energetics reaches a predetermined dangerous temperature. The lifting plug is used as a shipping means to not only lift the munitions but to also protect the munitions from the environment until the fuze is attached.

In general, munitions have operating temperatures between about −60° F. to about 160° F. In case of a fire, the temperature of the munition raises beyond a safe operating temperature of, for example, about 160° F., and the energetics inside the munition phase change from solid to liquid causing an internal "hoop pressure" that causes the munition to explode in a high order reaction when a temperature higher than about 160° F. is reached. This reaction is undesired and if the internal hoop pressure could be relieved, the energetics would not undergo high order detonation but instead a combustion rather than an explosion would occur.

This phase change phenomena also creates a hoop pressure inside the munition that the lifting plug of the present invention uses to release the lifting plug from the ring. The hoop pressure rises as the temperature increases above the operating temperature of the munition. The lifting plug has a eutectic seal at the joint between the lifting plug and the ring. The eutectic seal is maintained until a specific temperature is reached at which point, the eutectic material phase changes from solid to liquid. At this point, any mechanical features that bond the lifting plug to the ring are nullified, and the lifting plug is free to separate from the threaded ring via the hoop pressure forces of the energetics within the munitions and thus not allowing the munition to have a high order reaction. In having the energetic reaction reduced to a combustion, rather than a high order reaction allows for firefighting efforts in what would normally be a hazardous environment. A firefighting capability is most useful for ship board fires as well as in ammunition depot fires.

Figure 4:
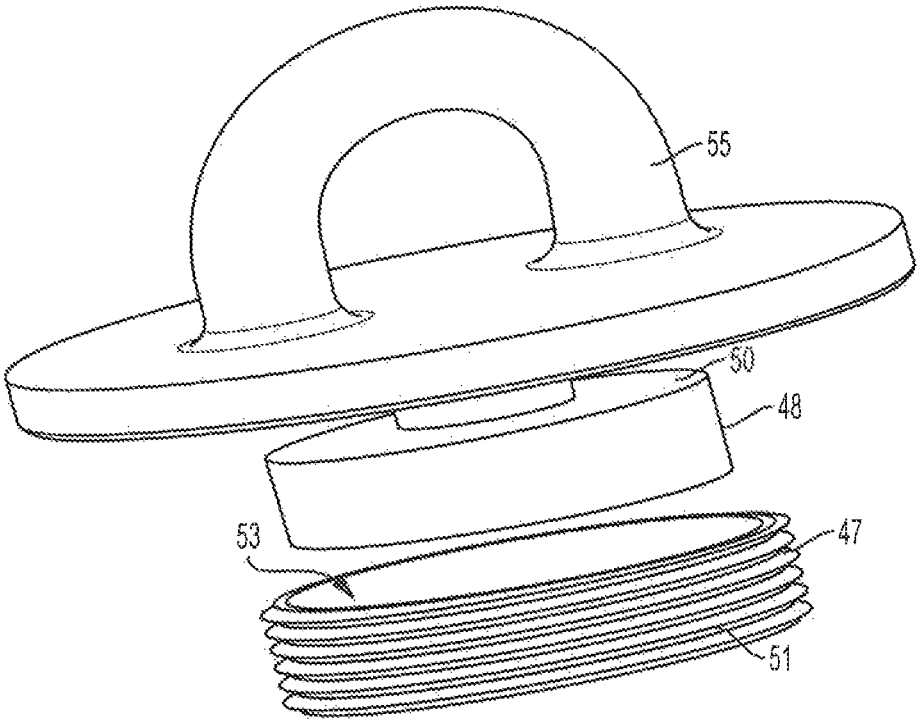
FIG. 4 is a perspective exploded view of a lifting plug of the present invention which can be used in combination with a ring designed to be in tight engagement with the lifting plug and threaded engagement with the threaded cavity on the munition.

FIG. 4 shows the threaded ring 47 of the present invention which facilitates venting of hot cook-off gases from the munition and separation of the lifting plug from a munition. Ring 47 is designed to release a modified lifting plug 55 from ring 47 when assembled in a fuze cavity of a munition. Release of lifting plug 55 is due to the hoop pressure developed within the munition as its temperature rises. In this case, the energetics goes through a phase change from solid to liquid as the temperature rises, thus generating a volume differential or internal cavity pressure.

This internal cavity pressure increases at elevated temperatures and is taken advantage of because a eutectic material is used to solder the joint 57 between modified lifting plug 55 and ring 47. This soldered joint 57 remains solid until the eutectic melts at a predetermined temperature above the operating temperature of the munition. That is, the eutectic changes to a liquid and then becomes a lubricant for the modified lifting plug 55 to be able to easily release from the ring 47.

Ring 47 has two surfaces: external threads 51 and internal surface 53. External threads 51 match the current threads on the fuze cavity. Internal surface 53 facilitate attachment of ring 47 to lifting plug 55, so that a gap is created to have the reflow of solder/eutectic between the lifting plug and the ring.

The gap between the lifting plug 55 and the ring 51 is about 0.002 to about 0.005 inches per side around the circumference, but in other embodiments this gap can be 100% or more, smaller or greater. This results in the lifting plug being able to support greater than 450 pounds at ambient temperatures. Advantageously, by removing the threaded interface between the engagement portion 50 and the ring 47, the venting area is enlarged thereby providing greater venting capability.

In a preferred embodiment, the joint 57 facilitates the flow of the one or more eutectic material. Preferably, the base metals of the new lifting plug 55 and ring 47 can be plated with a material to improve the "wicking" action of the eutectic.

As the temperature rises in the interior cavity of the munition, the internal pressures are exerted on lifting plug 55. When the eutectic composition in joint 57 melts or phase changes, then the internal pressure causes the lifting plug 55 to separate.

In one embodiment, the eutectic composition melts or phase changes at about 200° F. In an alternate embodiment, the eutectic composition melts or phase changes at about 250° F. In an alternate embodiment, the eutectic composition melts or phase changes at about 280° F. The temperature can be controlled with the type of eutectic being used. Each eutectic has its own melting temperature and can be specified as needed.

In one embodiment, the eutectic composition is selected from the group consisting of $B_{i58}S_{N42}$, $B_{i57}S_{n42}A_{g1}$, and $S_{n51.2}P_{b30.6}C_{d18.2}$. The eutectic materials that have a melting temperature range include; $B_{i55}P_{b44}S_{n1}$, $B_{i4}P_{b55.5}S_{n40.5}$, $S_{n42}A_{g1}$, $B_{i57}S_{n42}A_{g1}$ The present description is further illustrated by the following examples, which should not be construed as limiting in any way. The contents of all cited references (including literature references, issued patents, and published patent applications as cited throughout this application) are hereby expressly incorporated by reference.

Lifting plug comprises a lifting ring connected to an engagement portion 50 via a neck. The engagement portion comprises an exterior surface 48 for interfacing with internal surface 53 of ring 47. Ring 47 can be fabricated from a material stronger than the base metal of the lifting plug. This feature retains the current lifting plug's ability to indicate damage transparent to the new design. Additionally, ring 47 allows for the load bearing capability to be maintained as in the current design.

Figure 5:
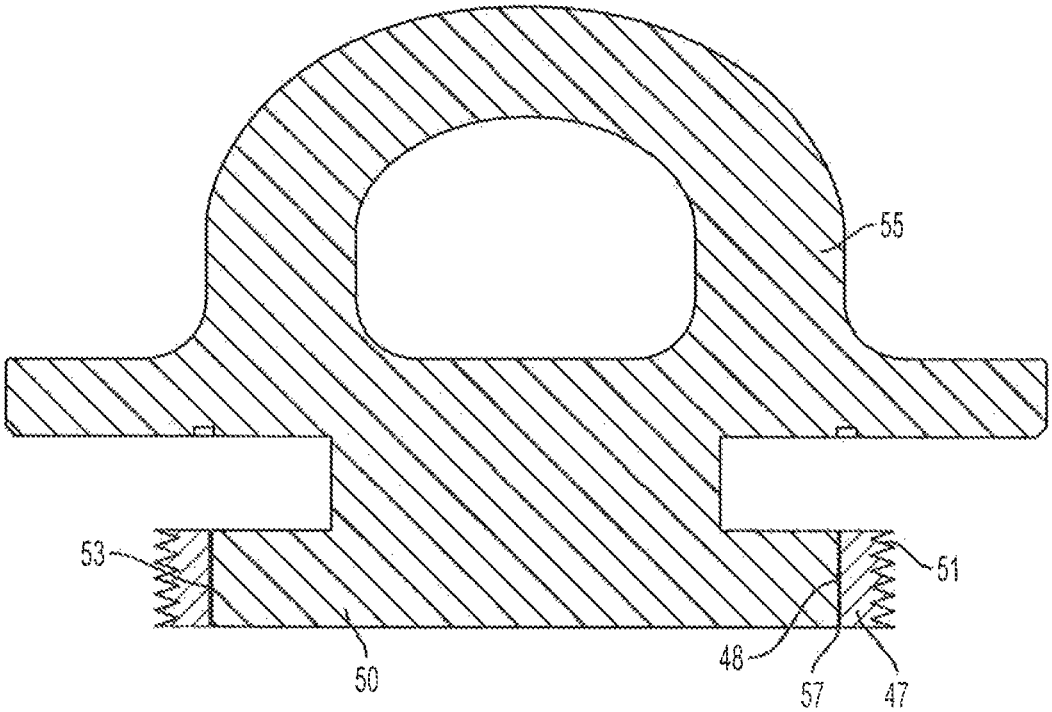
FIG. 5 is a side view of a lifting plug of the present invention with a ring inserted thereon in tight engagement, and which also is in sealing engagement with the lifting plug by virtue of a sealing solder of eutectic metal.

As shown in FIG. 4, current lifting plug design 37 is maintained except the lifting plug 37 has a ring 47 added. Ring 47 external thread 51 has the thread needed for threaded engagement with fuze cavity (not shown) in a munition. In this embodiment, ring 47 internal surface 53 is a means of assembling same onto outer surface 48 of engagement portion 50 of new lifting plug 55. When assembled, ring 47 and new lifting plug 55 are "soldered" together with a eutectic solder that can be one or more eutectic materials (not shown), at a joint 57 as illustrated in FIG. 5. The one or more eutectic material flows as solder would, and provides a solid bond between new lifting plug 55 and ring 47. According to the present invention, the new lifting plug 55 can detach itself from the ring 47 upon reaching an elevated predetermined temperature.

Although engagement portion 50 is shown as being circular in FIG. 4, in other embodiments engagement portion 50 can be any other suitable shape, such as a triangular shape, a square shape, a rectangular shape, a pentagon shape and so on. In these other embodiments, the interior surface 53 of ring 47 would have a corresponding shape, such as when engagement portion 50 is a square shape the interior surface 53 would have a corresponding square shape. In these other embodiments, the external threads 51 of ring 47 would still be of a shape needed for threaded engagement with the fuze cavity of the munition.

Figure 6:
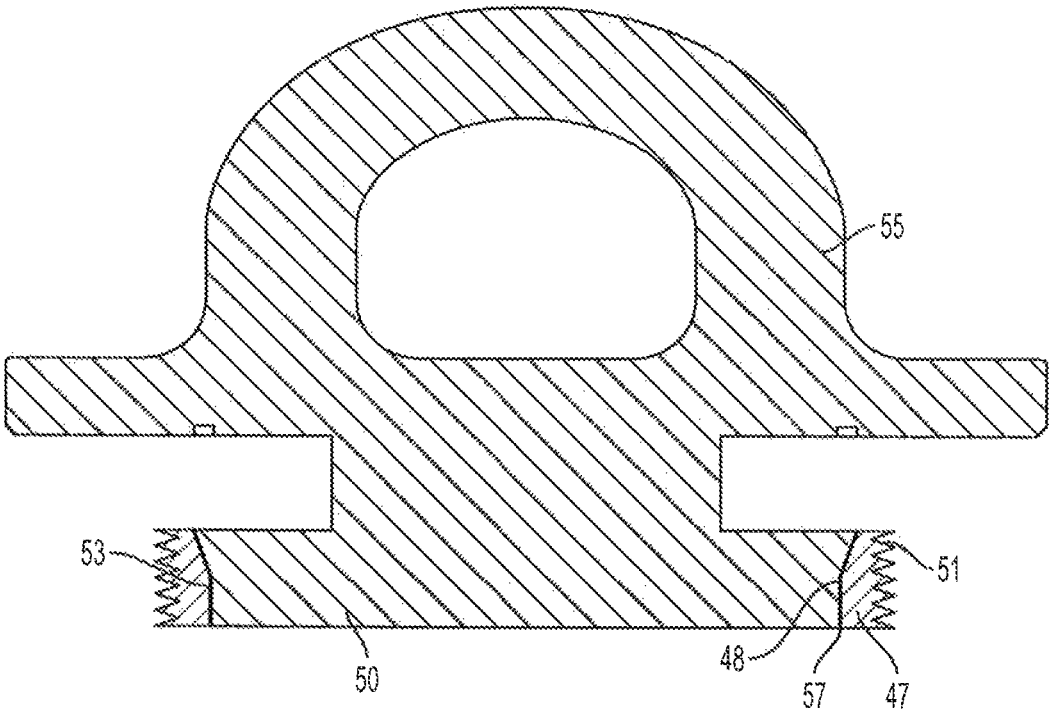
FIG. 6 is a side view of another embodiment of a lifting plug of the present invention with a ring inserted thereon in tight engagement, and which also is in sealing engagement with the lifting plug by virtue of a sealing solder of eutectic metal.

As shown in FIG. 5, internal surface 53 of ring 47 is a flat or substantially flat surface and exterior surface 48 of engagement portion 50 is also flat or substantially flat. In other embodiments, the exterior surface 48 can include two surfaces and internal surface 53 also includes two surfaces, as shown in FIG. 6. Although FIG. 6 illustrates two surfaces, three or more surfaces can be included in both exterior surface 48 and internal surface 53.

Figure 7:
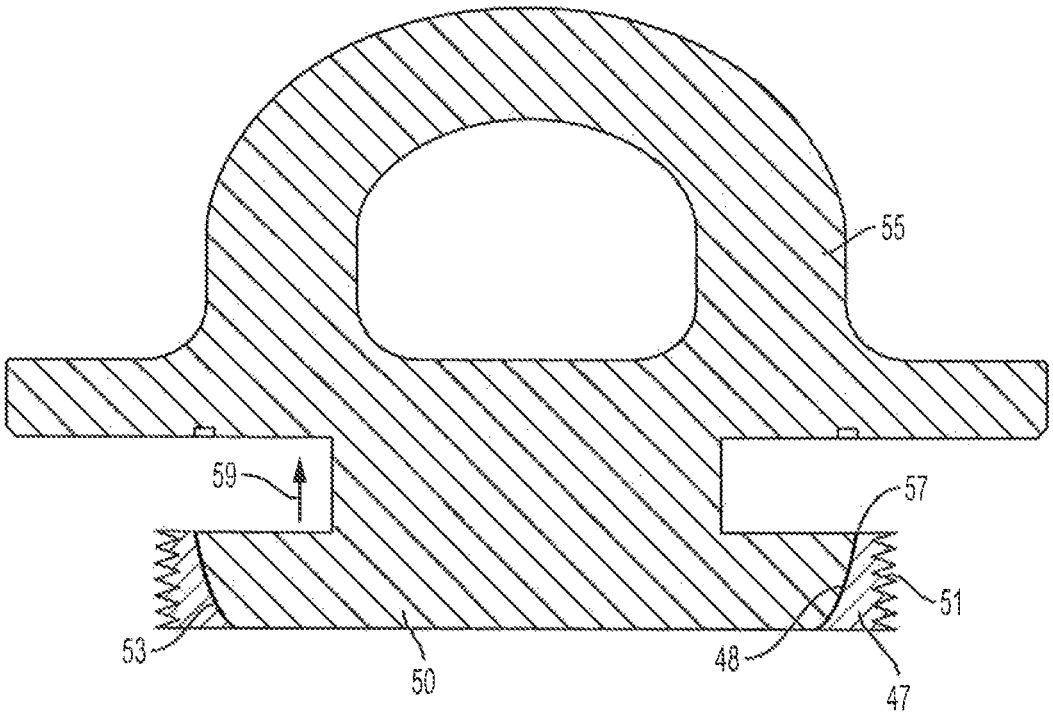
FIG. 7 is a side view of another embodiment of a lifting plug of the present invention with a ring inserted thereon in tight engagement, and which also is in sealing engagement with the lifting plug by virtue of a sealing solder of eutectic metal.

Another embodiment is illustrated in FIG. 7, in this embodiment internal surface 53 and exterior surface 48 are curved, with the center of their radius of curvature being toward the center of the engagement portion 50. Although a single radius of curvature is illustrated in FIG. 7 for internal surface 53 and exterior surface 48, in other embodiments, internal surface 53 and exterior surface 48 can include two or more radii of curvature.

Manufacture and assembly of the lifting plug may be improved by varying the profile of the internal surface 53 and the exterior surface 48. The internal surface 53 and exterior surface 48 may interface to provide a positive stop for the engagement portion 50 within the ring 47. In addition, the internal surface 53 and exterior surface 48 may interface such that the engagement portion 50 is self-locating within the ring 47.

Further, although internal surface 53 and exterior face 48 are described as flat surfaces and curves in the disclosed embodiments, any other shape or configuration to allow for lifting plug 55 to move in the direction of arrow 59 upon melting of eutectic joint 57 are suitable.

Further still, internal surface 53 and exterior surface 48 are illustrated in the figures as being smooth, but in other embodiments, both internal surface 53 and exterior surface 48 can be variable along their height. For instance, one or both of internal surface 53 and exterior surface 48 can be irregular.

Figure 8:
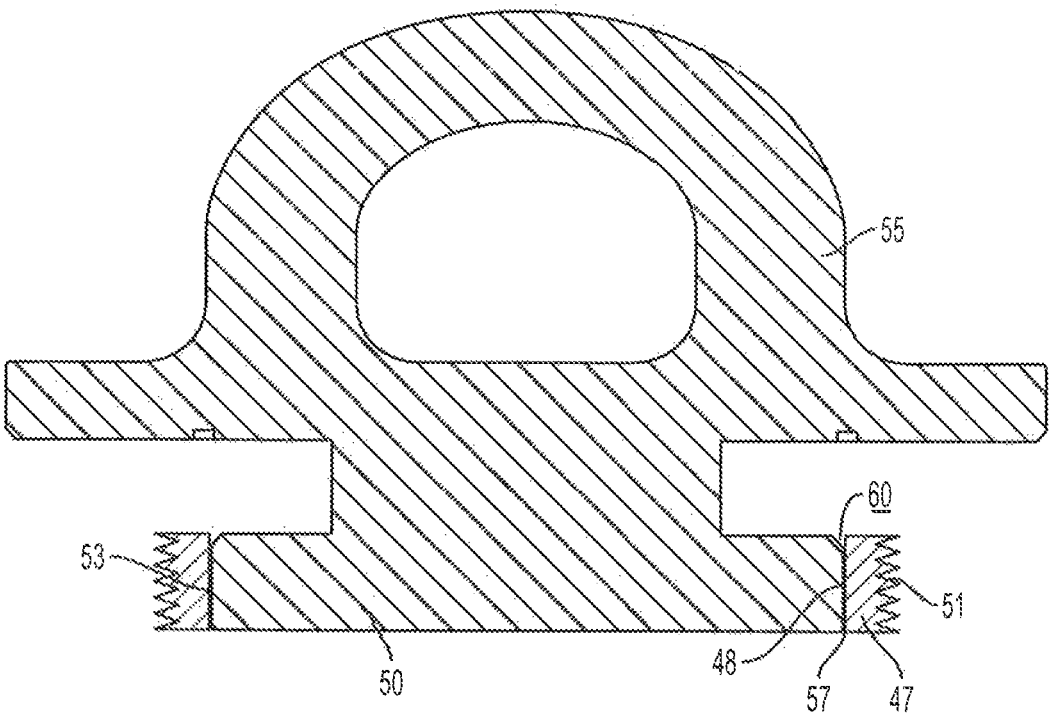
FIG. 8 is a side view of another embodiment of a lifting plug of the present invention with a ring inserted thereon in tight engagement, and which also is in sealing engagement with the lifting plug by virtue of a sealing solder of eutectic metal.

In another embodiment of lifting plug 55, engagement portion 50 can include a groove 60 that extends along the upper portion of outer surface 48, as shown in FIG. 8. Groove 60 can be included with any shape of internal surface 53 and exterior surface 48, such as being combined with any embodiment disclosed above and those illustrated in FIGS. 4-7. In some embodiments groove 60 can be filled with the eutectic material in eutectic joint 57, in other embodiments groove 60 can be left substantially empty or empty, as shown in FIG. 8.

Figure 9:
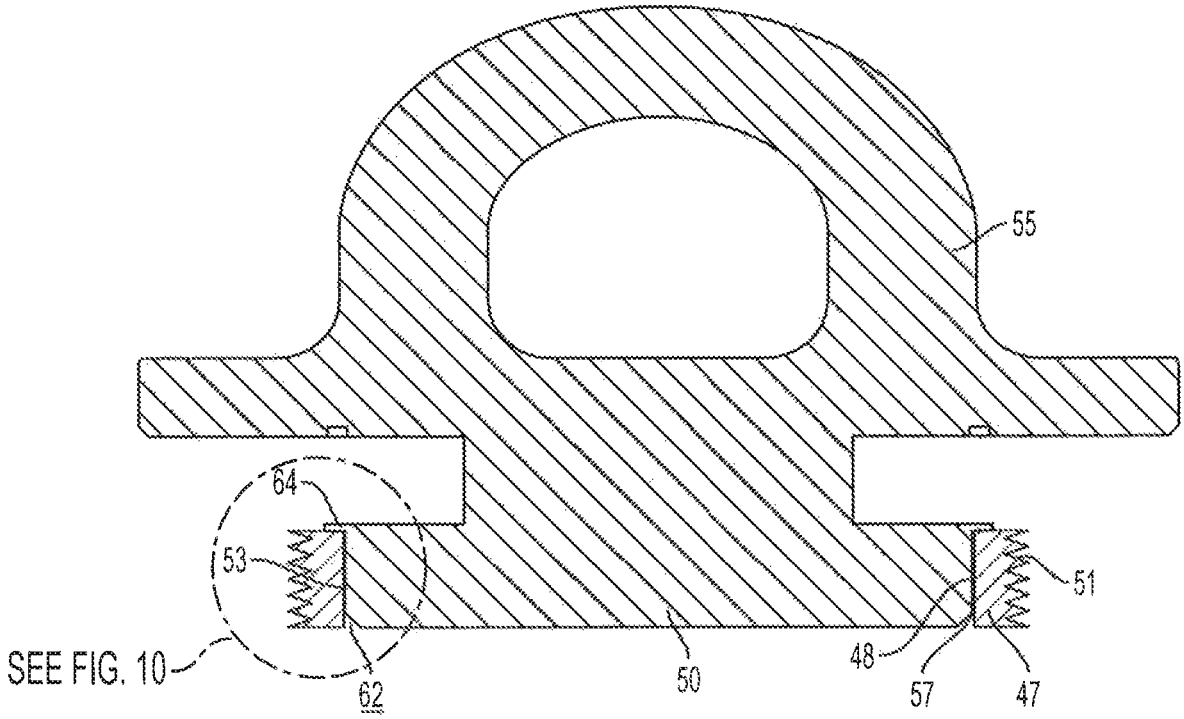
FIG. 9 is a side view of another embodiment of a lifting plug of the present invention with a ring inserted thereon in tight engagement, and which also is in sealing engagement with the lifting plug by virtue of a sealing solder of eutectic metal.

In another embodiment of lifting plug 55, engagement portion 50 can include a groove 62 that extends along the upper portion of outer surface 48, as shown in FIG. 9. Groove 62 can be included with any shape of internal surface 53 and exterior surface 48, such as being combined with any embodiment disclosed above and those illustrated in FIGS. 4-8. Also included in this embodiment is protrusion 64 that extends from the upper portion of outer surface 48. Protrusion 64 can be included with any shape of internal surface 53 and exterior surface 48, such as being combined with embodiments disclosed above and those illustrated in FIGS. 4-7.

In embodiments in which the groove 60 is filled with eutectic material in eutectic joint 57, groove 60 provides a convenient location for dispensing eutectic material onto the lifting plug in a manufacturing process.

Figure 10:
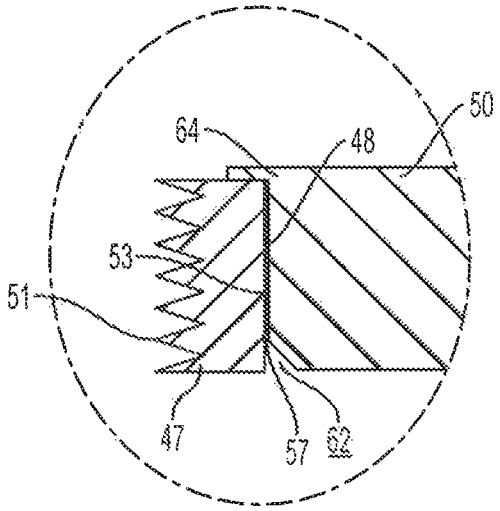
FIG. 10 is a magnified view of a portion of the lifting plug illustrated in FIG. 9.

A magnified view of the protrusion 64 and groove 62 is shown in FIG. 10. As can be seen from FIG. 10, the upper surface of ring 47 rests on the lower surface of protrusion 64. The interaction of the lower surface of protrusion 64 and upper surface of ring 47 provides a positive stop for the engagement portion 50 within the ring 47.

The described embodiments and examples of the present disclosure are intended to be illustrative rather than restrictive, and are not intended to represent every embodiment or example of the present disclosure. While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. Further, various modifications and variations can be made without departing from the spirit or scope of the disclosure as set forth in the following claims both literally and in equivalents recognized in law.

What is claimed is:

1. A gas pressure discharge valve for an unfuzed munition having a fuze cavity with internal threads, said discharge valve comprising a ring threaded externally and having a smooth interior surface, with the external threads adapted to engage internal threads on the threaded fuze cavity, and the smooth interior surface on the ring adapted to facilitate attachment of the ring to a lifting plug, said lifting plug comprising a lifting ring connected to a neck portion which in turn is connected to an engagement portion having an external surface, a lower portion of said external surface comprising a groove and an upper portion of said external surface comprising a protrusion extending from external surface, wherein a gap is created that allows solder to flow between the interior surface of the ring and the external surface of the engagement portion of the lifting plug, the solder comprising one or more eutectic materials having a melting point below a predetermined critical temperature and pressure of cook-off gases generated by the munition.

2. The gas discharge valve of claim 1, wherein the lifting plug separates from the ring when cook-off gas temperatures have risen high enough to melt the eutectic solder of the between the interior surface of the ring external surface of the engagement portion of the lifting plug and pressure build-up of cook-off gases is sufficiently high to cause separation of the lifting plug.

3. The gas discharge valve of claim 1, wherein the ring is formed of carbon steel, stainless steel, titanium, or other alloys thereof.

4. The gas discharge valve of claim 1, wherein the one or more eutectic materials wet the surfaces of both the lifting plug and ring and creates an environmental and pressure seal.

5. The gas discharge valve of claim 4, wherein the one or more eutectic material seals the gap and prevents release of cook-off gases until these gases reach a predetermined temperature, and the exterior surface of the engagement portion of the lifting plug, and the interior surface of the ring are boated with a wetting agent to facilitate wetting of the gap by the one or more eutectic material.

6. The gas discharge valve of claim 1, wherein the one or more eutectic material is selected from the group consisting of bismuth, lead and tin.

7. The gas discharge valve of claim 1, wherein there is a sufficient clearance between the interior surface of the ring and the external surface of the engagement portion of the lifting plug to facilitate flow of eutectic material into the gap, and the ring is formed from a material stronger than the material from which the neck of the lifting plug is formed, whereby to maintain a damage indicator of the lifting plug neck.

8. A venting lifting plug for an unfuzed munition having a fuze cavity with internal threads, said venting lifting plug comprising a ring threaded externally and having a smooth interior surface, with the external threads adapted to engage internal threads on the treaded fuze cavity, and the smooth interior surface on the ring adapted to facilitate attachment of the ring to the lifting plug, said lifting plug comprising a lifting ring connected to a neck portion which in turn is connected to an engagement portion having an external surface, a lower portion of said external surface comprising a groove and an upper portion of said external surface comprising a protrusion extending from said external surface, wherein a gap is created that allows solder to flow between the interior surface of the ring and the external surface of the engagement portion of the lifting plug, the solder comprising one or more eutectic materials having a melting point below a predetermined critical temperature and pressure of cook-off gases generated by the munition, and the ring is formed of carbon steel, and the one or more eutectic material wets surfaces of both the lifting plug and ring.

* * * * *